US006496089B1

(12) United States Patent
Åkesson et al.

(10) Patent No.: US 6,496,089 B1
(45) Date of Patent: Dec. 17, 2002

(54) DEVICE FOR TUNING OF A DIELECTRIC RESONATOR

(75) Inventors: Daniel Åkesson, Hässelby (SE); Joakim Östin, Stockholm (SE)

(73) Assignee: Allgon AB, Täby (SE)

( * ) Notice: Subject to any disclaimer, the term of this patent is extended or adjusted under 35 U.S.C. 154(b) by 0 days.

(21) Appl. No.: 09/719,542

(22) PCT Filed: Jun. 18, 1999

(86) PCT No.: PCT/SE99/01111

§ 371 (c)(1),
(2), (4) Date: Feb. 5, 2001

(87) PCT Pub. No.: WO99/66585

PCT Pub. Date: Dec. 23, 1999

(30) Foreign Application Priority Data

Jun. 18, 1998 (SE) ..... 9802191

(51) Int. Cl.[7] ..... H01P 7/10
(52) U.S. Cl. ..... 333/219.1; 333/235; 333/232
(58) Field of Search ..... 333/235, 219.1, 333/232, 231

(56) References Cited

U.S. PATENT DOCUMENTS

| | | | | |
|---|---|---|---|---|
| 4,459,570 A | | 7/1984 | Delaballe et al. | 333/202 |
| 4,728,913 A | * | 3/1988 | Ishikawa et al. | 333/235 |
| 4,956,617 A | | 9/1990 | Bowlds | 331/96 |
| 5,315,274 A | | 5/1994 | Särkkä | 333/219.1 |
| 5,703,548 A | | 12/1997 | Särkkä | 333/235 |
| 5,736,912 A | * | 4/1998 | Mikami et al. | 333/235 |

* cited by examiner

*Primary Examiner*—Robert Pascal
*Assistant Examiner*—Stephen E. Jones
(74) *Attorney, Agent, or Firm*—Jacobson Holman PLLC

(57) ABSTRACT

The present invention relates to a dielectric resonator (20) comprising a dielectric resonator body (30, 40, 50, 60, 70, 80), where the resonator body includes at least two resonant elements (25, 26), wherein by altering the shape of the dielectric resonator body the resonance frequency (fr) in the dielectric resonator can be adjusted. The alteration of the shape of the resonant body is performed by rotation of one element in relation to another element in such a way that said elements are in mechanical contact, through connecting means, in at least one location at any time.

20 Claims, 8 Drawing Sheets

DEVICE FOR TUNING OF A DIELECTRIC RESONATOR

TECHNICAL FIELD OF THE INVENTION

The present invention relates to a device for tuning of a resonator, more specifically to a resonator comprising a resonator body where the shape of the body can be changed and thus change the resonance frequency.

DESCRIPTION OF RELATED ART

Among high-frequency and microwave resonator structures, so-called dielectric resonators have recently become increasingly interesting as they offer e.g. the following advantages over conventional resonator structures: smaller circuit sizes, higher integration level, higher efficiency and lower cost of manufacture. Any element having a simple geometric shape made of a material having low dielectric losses and a high relative dielectric constant can be used as a high Q dielectric resonator. For reasons of manufacturing technique, the dielectric resonator is usually cylindrical, such as a cylindrical disc.

The resonance frequency of the dielectric resonator is primarily determined by the dimensions of the resonator body. Another factor affecting the resonance frequency is the environment of the resonator. The electric or magnetic field of the resonator and, thus, the resonance frequency can be intentionally affected by introducing a metal surface or any other conductive surface in the vicinity of the resonator. To adjust the resonance frequency of the dielectric resonator, a common practice is to adjust the distance between the conductive metal surface and the planar surface of the resonator. The adjusting mechanism may be e.g. an adjustment screw attached to the housing surrounding the resonator.

Alternatively, it is also possible to bring another dielectric body to the vicinity of the resonator body instead of a conductive adjustment body. One prior art design of this kind, based on dielectric plate adjustment is shown in FIG. 1.

In this kind of adjusting method, however, it is typical that the resonance frequency varies nonlinearly as a function of the adjusting distance. Due to the non-linearity and the steep slope of adjustment, accurate adjustment of the resonance frequency is difficult and demands great precision, particularly at the extreme ends of the control range.

Frequency adjustment is based on a highly accurate mechanical movement, the slope of adjustment also being steep. In principle, the length and thus the accuracy of the adjusting movement may be increased by reducing the size of the metallic or dielectric adjustment plane.

Due to the non-linearity of the above mentioned adjusting techniques, however, the achieved advantage is small, since the portion of the adjusting curve which is too steep or too flat either at the beginning or at the end of the adjusting movement can not be used. As a result, adjusting the resonance frequency of a dielectric resonator with these solutions sets very high demands on the frequency adjustment mechanism, which in turn, increases the material and production costs. In addition, as the mechanical movements of the frequency adjustment device must be made very small, adjustment will be slower.

In U.S. Pat. No. 5,703,548, by Särkkä, the above problems was solved by introducing a dielectric resonator comprising a plurality of dielectric adjustment planes. This results in improved linearity of frequency adjustment and a longer adjusting distance, which both improve the accuracy of adjustment.

In U.S. Pat. No. 4,459,570, by Delaballe et al., a similar problem has been solved by introducing a resonator having a dielectric constant of an adjustment plate with half the value of the dielectric constant of the resonator disc.

In U.S. Pat. No. 5,315,274, by Särkkä, where tuning of a resonance frequency is achieved by a dielectric resonator comprising two cylindrical discs positioned on top of each other, which are radially displaceable with respect to each other and thereby varying the shape of the resonator.

SUMMARY OF THE INVENTION

The basic idea of the invention is to utilise the linear part of the adjustment curve although the curve is steep, thus difficult to adjust and to keep stable.

The object of the invention is a dielectric resonator in which the resonance frequency can be adjusted more accurately than previously within the steep slope.

In accordance with the invention this object is achieved by an inventive dielectric resonator, comprising a dielectric resonator body, where the resonator body includes at least two resonant elements, wherein by altering the shape of the dielectric resonator body the resonance frequency of said dielectric resonator can be adjusted. The alteration of the shape of the resonant body is performed in such a way that said elements are in mechanical contact, through connecting means, in at least one location at any time. This contact may be established via an interconnecting element. The dielectric resonator body also comprise means for moving at least a first resonant element in relation to at least a second resonant element of the resonant body and thus altering the shape of said body. The movement is be performed by rotation of the first element around an axis.

The dielectric resonator body may further comprise connecting means for connecting said first and second element, and the rotation, of said first element, can cause a displacement of said first element, in relation to said second element, in a direction of the rotation axis.

The resonator may comprise additional means for adjustment of the displacement by means for mechanical guidance. These means for adjustment may be incorporated in the connecting means by which the resonating elements are in contact with each other in at least one location.

The resonating elements may also be circularly cylindrical, where the connecting means are implemented in a circular or part-circular path, having a centre at said rotation axis.

A first advantage with the present invention is that a maximal stability in respect of relative displacement and vibrations between the elements is achieved.

A second advantage is that a temperature compensating resonator structure easily can be implemented.

A third advantage is that a compact resonator structure is obtainable.

A fourth advantage is that a high sensitivity can be obtained in respect of resonance frequency versus displacement.

A fifth advantage is that this type of dielectric resonator body can operate in a high power environment.

In the following, the invention will be disclosed in greater detail by way of example with reference to the attached drawings.

DETAILED DESCRIPTION OF EMBODIMENTS

Figure 1A:
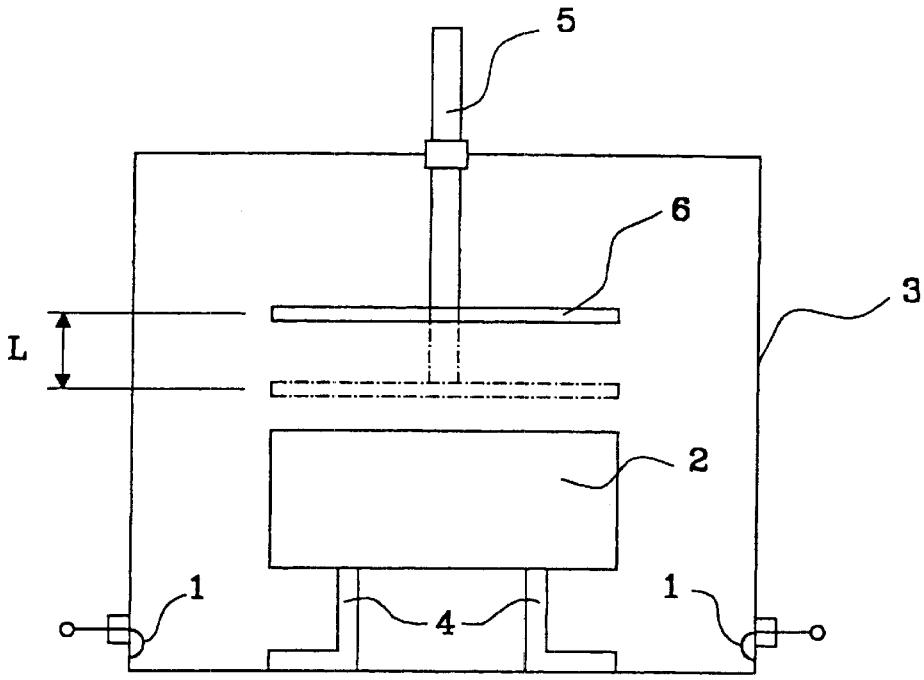
FIG. 1a (PRIOR ART)
FIG. 1*a* shows a cross-sectional side view of a dielectric resonator in accordance with the prior art.

FIG. 1*a* shows a cross-sectional side view of a dielectric disc resonator according to the prior art, as previous mentioned, which comprises inductive coupling loops 1 (input and output), a dielectric resonator disc 2 installed in a metal casing 3, and supported by a dielectric support 4, and a frequency controller attached to the metal casing 3, comprising an adjustment screw 5 and a dielectric adjustment plate 6. The resonance frequency of the resonator depends on a displacement L in accordance with a graph shown in FIG. 1*b*.

Figure 1B:
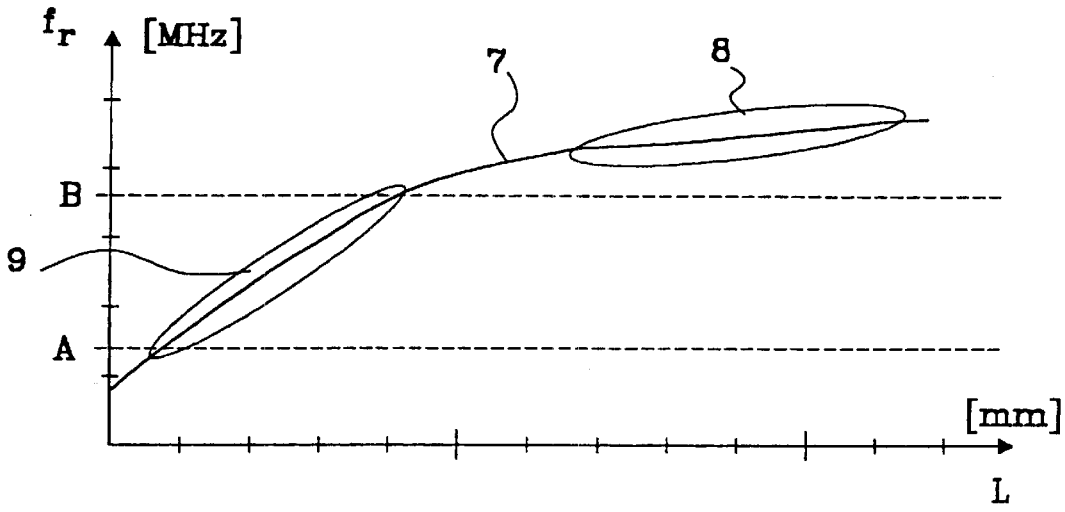
FIG. 1b (PRIOR ART)
FIG. 1*b* shows a graph of resonance frequency versus displacement.

As appears from FIG. 1*b*, the resonance frequency $f_r$ varies as a non-linear function 7 of the displacement L. With an appropriate choice of material and dimensions of the resonator disc 2 and adjustment plate 6 in combination with the size metal casing 3, a desired, approximately linear, frequency range A–B may be obtained in a high sensitivity area 9. The resonator frequency $f_r$ is tuneable within this range when adjusting the displacement L. The problem with this construction, when a high sensitivity is desired, is that the linear frequency range usually corresponds to a very small displacement L, which in turn may cause problems with stability and accuracy.

In prior art devices, an area with low sensitivity 8 is used, instead of the linear area with high sensitivity 9 that the present invention is aimed for.

Figure 2:
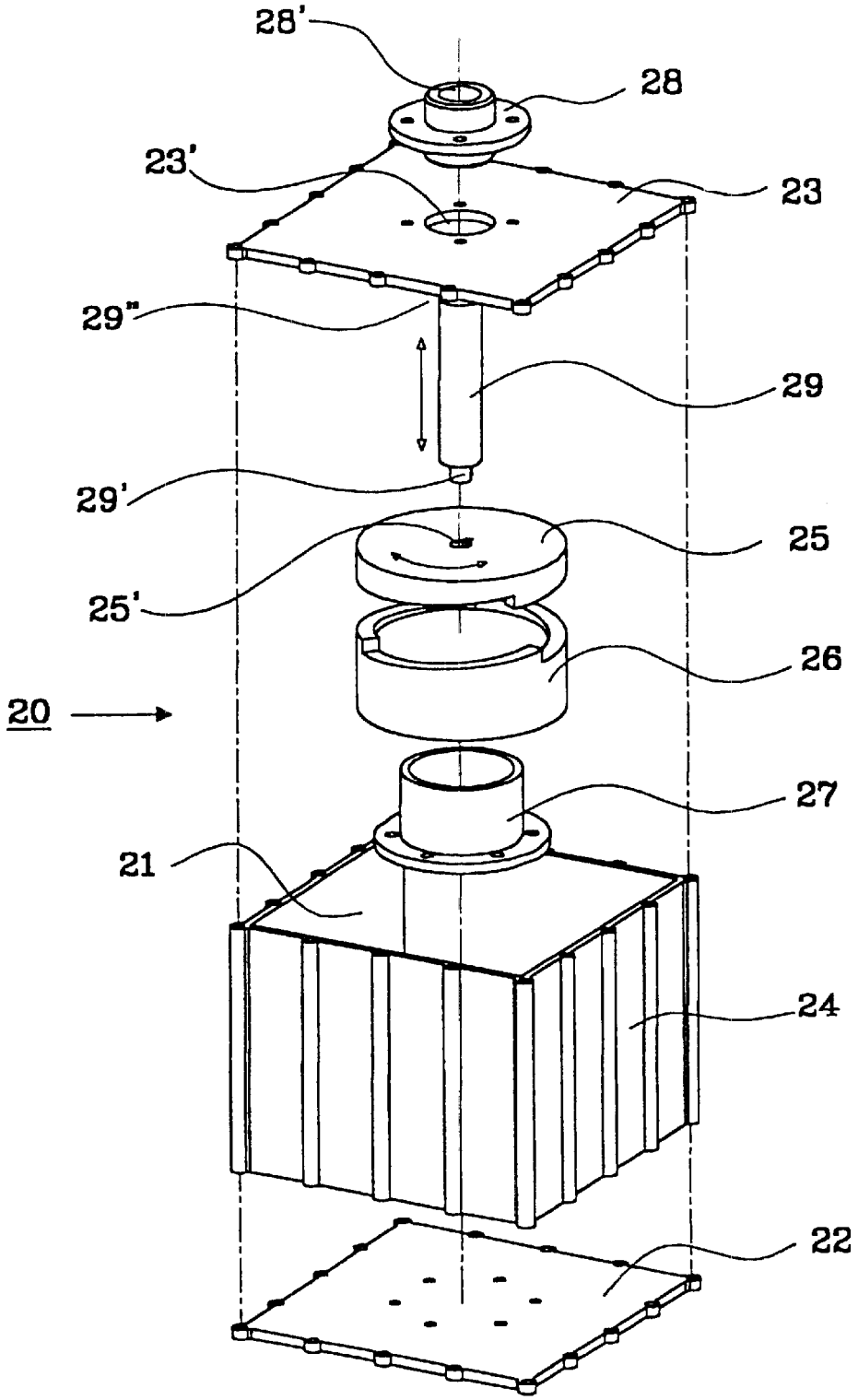
FIG. 2 shows an exploded perspective view of a dielectric resonator in accordance with the inventive concept.

FIG. 2 shows an exploded perspective view of an inventive dielectric resonator 20. The resonator comprises a housing, including a bottom wall 22, a top wall 23 and side walls 24 forming a cavity 21, a dielectric resonator body, a support 27, a bushing 28 and an adjustment rod 29. The dielectric body comprises, in this example, a first movable element 25 and a second element 26. The resonator 20 also have input and output means (not shown) mounted on said cavity 21.

An aperture 23' is formed in the top wall 23 in which the bushing 28 is located. The bushing 28 is secured to the top wall 23 by fastening means, such as screws, rivets, glue or the like, and the adjustment rod 29 is slidably arranged inside the bushings aperture 28'. A first end 29' of the adjustment rod 29 is inserted into a centrally formed attachment 25' on the first element 25. A second end 29" of the rod 29 is arranged to be on the outside of said cavity 21.

By rotating means, acting on the second end 29" of said rod 29, the first element 25 is thus turned relative to the cavity 21.

The support 27 is secured to the bottom plate 22 by fastening means, such as screws, rivets, glue or the like, and the second element 26 is in turn attached to the support, which fixates said element 26 relative to the cavity 21.

The first element 25 and the second element 26 are arranged in such a way that their facing surfaces are partly in contact with each other in at least one location, preferably three locations. To ensure a stable contact the adjustment rod 29 is axially biased, spring loaded in some way (not shown in the drawing), to create a compressing force between the elements 25 and 26.

The position of the second element 25 relative the first element 26, of the resonator body, determines the resonance frequency $f_r$ of the resonator. The frequency is adjusted by rotating the first element 25 in relation to the second element 26 by an adjustment mechanism, based on mechanical guidance, that is built into the resonator body, which is described in more detail below.

Figure 3A:
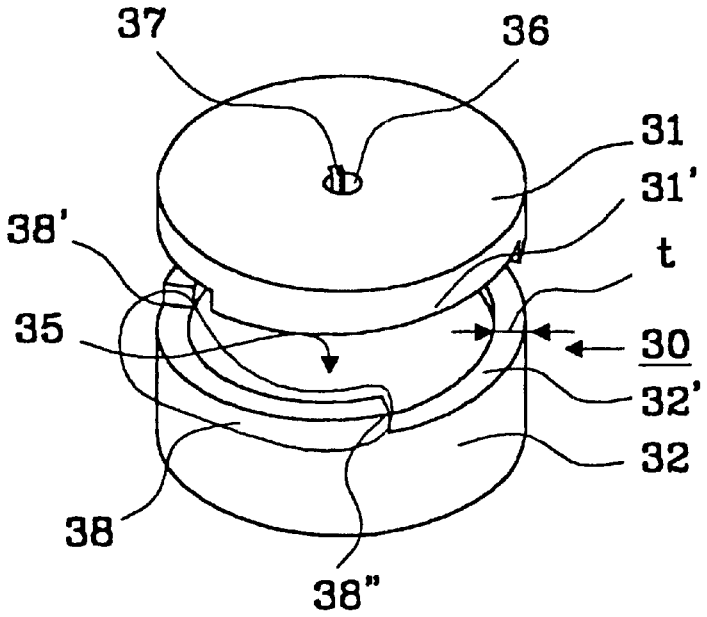
FIG. 3*a* shows an exploded perspective view of a two-part resonator body comprising two resonant element with a double slope adjustment means in accordance with the inventive concept.
Figure 3B:
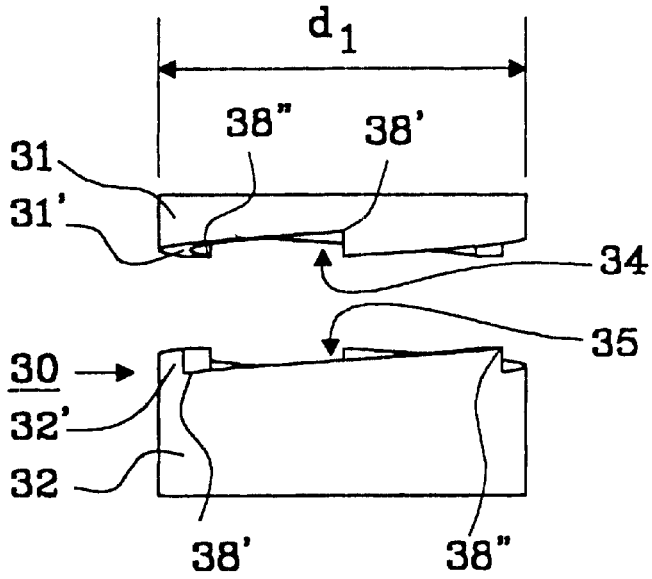
FIG. 3*b* shows a side view of the embodiment in FIG. 3*a*.

FIG. 3*a* and 3*b* show an embodiment of a two-part resonator body 30, comprising a first dielectric resonating element 31 and a second dielectric resonating element 32. Both elements are circularly cylindrical with an approximately equal outer diameter $d_1$ where an annular ridge 31', 32' is arranged circularly on the periphery of each elements facing surface 34 and 35, each ridge having a substantially equal thickness t. A centrally formed attachment 36 is arranged on the first element 31, where said attachment has a groove 37 for securing a rotating adjustment rod (not shown) as previously described in FIG. 2.

Each ridge 31', 32' is, in this example, divided into three separate contact sectors 38. Each sector has an essentially identical size and shaping, including a starting point 38', an end point 38" and an axially increasing slope there between. The shape of the resonator body 30 is thus changed by rotating the first element 31 in relation to the second element 32, causing the height of the resonating body 30 to change and thus the resonance frequency $f_r$.

Figure 3C:
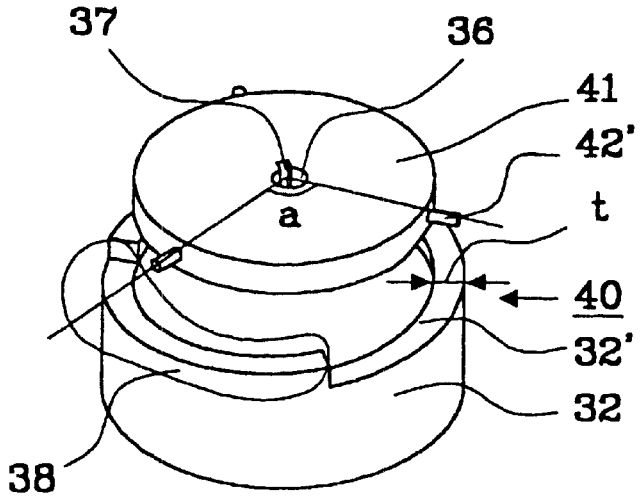
FIG. 3*c* shows an exploded perspective view of an alternative two-part resonator body comprising two resonant element with a single slope adjustment means in combination with a tracking means in accordance with the inventive concept.
Figure 3D:
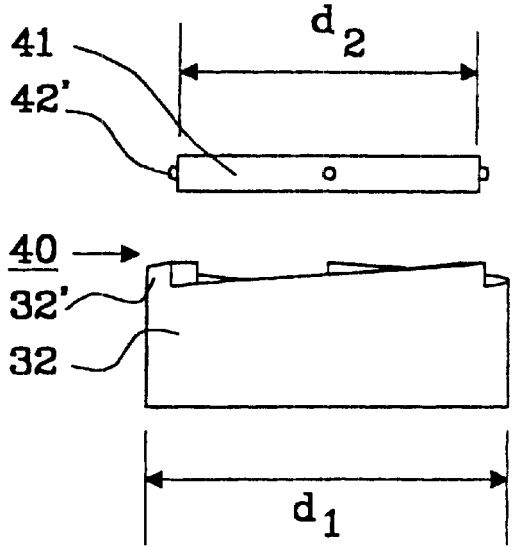
FIG. 3*d* shows a side view of the embodiment in FIG. 3*c*.

FIG. 3*c* and 3*d* shows an alternative embodiment of a two-part resonator body 40, similar to the embodiment described in FIG. 3*a* and 3*b*, except for the shaping of the first element. This alternative embodiment of a two-part resonator body comprise an alternative first element 41 having an outer diameter $d_2$, where said diameter is less than the outer diameter $d_1$ of the second element minus the double thickness t of the ridge ($d_2<d_1-2t$). A number of pins 42, corresponding to the number of contact sectors 38 of the ridge 32' on the second element 32, extends in a radial direction from the periphery of the first element 41. The best performance is achieved when the pins 42 are evenly angularly separated, in this case with an angular value a equal to 120 degrees provided identical sectors 38 of the ridge 32' on the second element 32.

The displacement of the elements is performed by rotating the first element 41 while each pin 42 is in contact with the surface of each contact sector 38, biased by spring means, as previously described in FIG. 2.

Figure 4A:
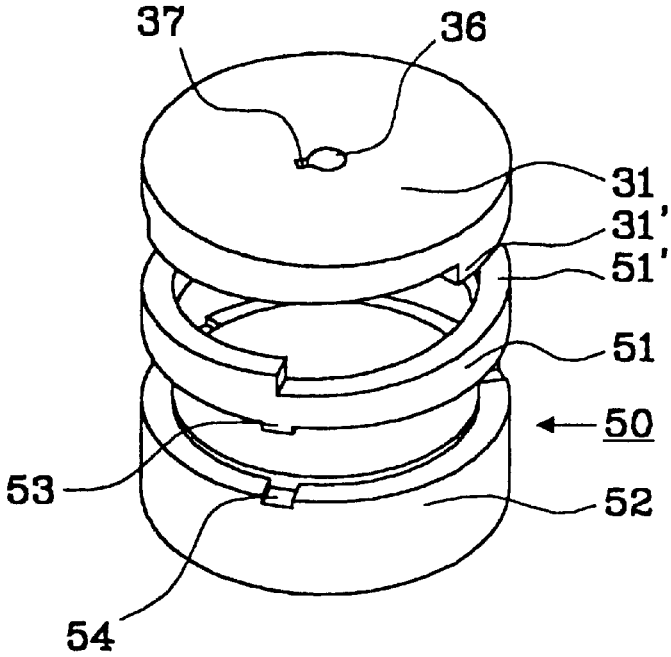
FIG. 4*a* shows an exploded perspective view of a three-part resonator body comprising two resonating elements and a first type of interconnecting element with a double slope adjustment means in accordance with the inventive concept.
Figure 4B:
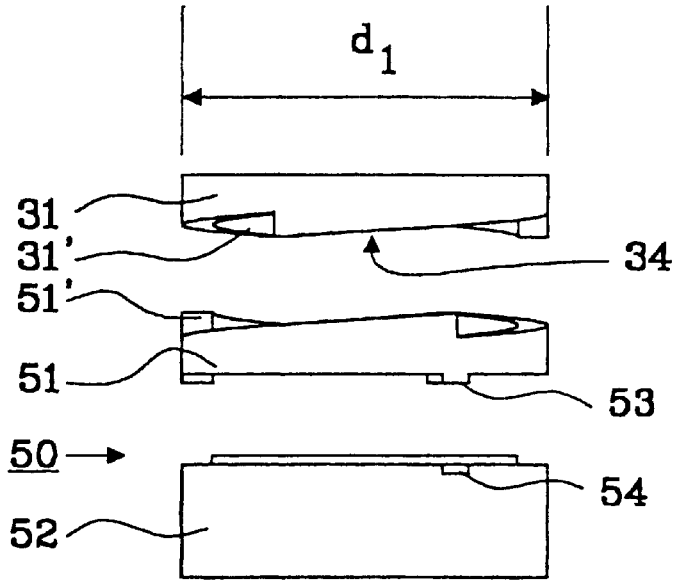
FIG. 4*b* shows a side view of the embodiment in FIG. 4*a*.

FIG. 4*a* and 4*b* show an embodiment of a three-part resonator body 50, comprising a first dielectric resonating element 31, as previously described in FIG. 3*a*, a second dielectric resonating element 52, and a ridge formed interconnecting element 51. The first and second elements 31 and 52 are circularly cylindrical and the interconnecting element 51 is tubular, all with approximately the same outer diameter $d_1$, where a first annular ridge 31' is arranged circularly on the periphery of the first elements 31 facing surface 34. A second ridge 51' is arranged on the ridge formed tubular interconnecting element 51, where the thickness t of said element is equal to the thickness of the first ridge 31'. A centrally formed attachment 36 is arranged on the first element 31, where said attachment has a groove 37 for securing a rotating adjustment rod (not shown) as previously described in FIG. 2.

The interconnecting element 51 is fixed to the second element 52 by at least of one stopper means 53, in this example three stopper means, arranged on said element 51, where said stopper means is placed in a corresponding groove 54 on said second element 52.

Each ridge 31', 51' is, in this example, divided into three separate contact sectors as described previously in FIGS. 3*a*–3*b*. The shape of the resonator body 50 is thus changed by rotating the first element 31 in relation to the interconnecting element 51, which is fixed to the second element 52, causing the height of the resonating body 50 to change and thus the resonance frequency $f_r$.

Figure 4C:
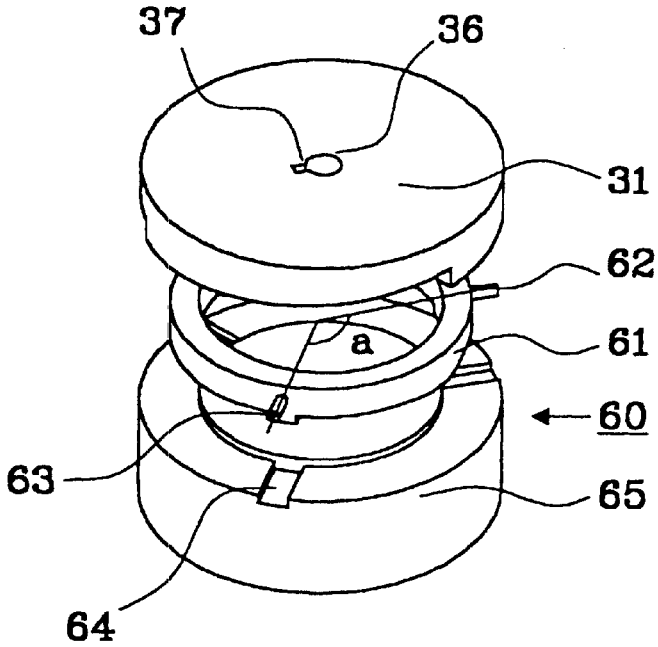
FIG. 4*c* shows an exploded perspective view of an alternative three-part resonator body comprising two resonating elements and a first type of interconnecting element with a single slope adjustment means in combination with a tracking means in accordance with the inventive concept.
Figure 4D:
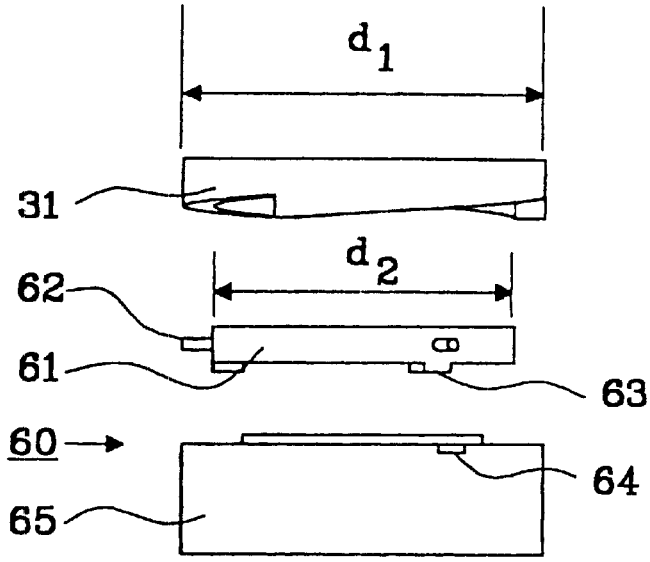
FIG. 4*d* shows a side view of the embodiment in FIG. 4*c*.

FIG. 4*c* and 4*d* shows an alternative embodiment of a three-part resonator body 60, similar to the embodiment described in FIG. 4*a* and 4*b*, except for the shaping of the interconnecting element. This alternative embodiment of a three-part resonator body comprise an alternative interconnecting element 61 having an outer diameter $d_2$, where said diameter is less than the outer diameter $d_1$ of the first element minus the double thickness t of the ridge ($d_2<d_1-2t$). A number of pins 62, corresponding to the number of contact sectors of the ridge 31' on the first element 31, extends in a radial direction from the periphery of the interconnecting element 61. The best performance is achieved when the pins 62 are evenly angularly separated, in this case with an angular value a equal to 120 degrees provided identical contact sectors of the ridge 31' on the first element 31, as previously described.

Stopper means 63 on the interconnecting element 61 and corresponding grooves 64 on the second element 65 are arranged to secure a radial fixing of the interconnecting element 61 to the second element 65.

The displacement of the elements is performed by rotating the first element 31 while each pin 62 is in contact with the surface of the first ridge 31', biased by spring means, as previously described in FIG. 2.

Figure 5A:
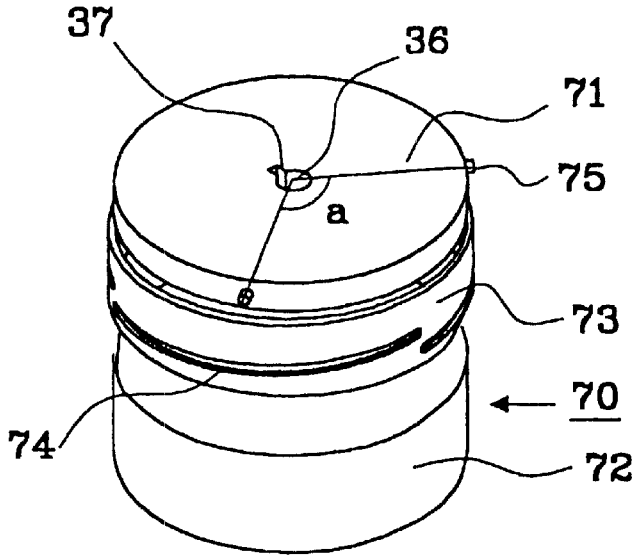
FIG. 5*a* shows an exploded perspective view of a three-part resonator body comprising two resonating elements and a second type of interconnecting element with a non-overlapping tracking guide in combination with a tracking means in accordance with the inventive concept.
Figure 5B:
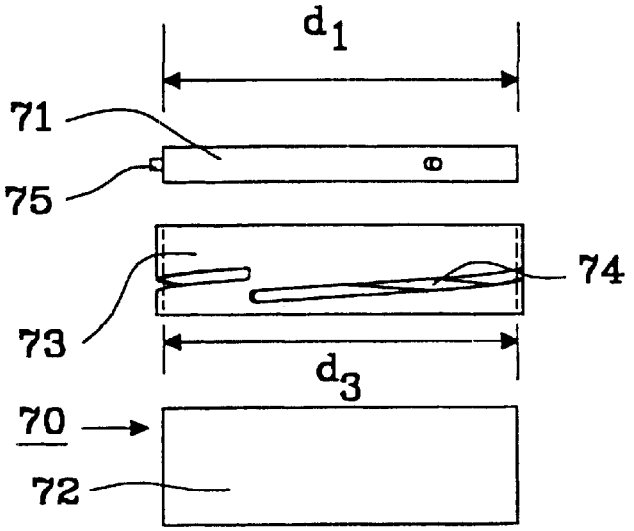
FIG. 5*b* shows a side view of the embodiment in FIG. 5*a*.

FIG. 5*a* and 5*b* show an embodiment of a three-part resonator body 70, comprising a first dielectric resonating element 71, a second dielectric resonating element 72, and a slit formed interconnecting element 73. The first and second elements 71 and 72 are circularly cylindrical with approximately the same outer diameter $d_1$ and the interconnecting element 73 is tubular with an inner diameter $d_3$ which is larger than said outer diameter $d_1$ ($d_3>d_1$). A centrally formed attachment 36 is arranged on the first element 71, where said attachment has a groove 37 for securing a rotating adjustment rod (not shown) as previously described in FIG. 2.

The interconnecting element 73 have a number of slits 74 arranged in the tubular wall extending in an axial direction. Each slit is arranged to be an axially incrementing guide for a pin 75, where said pins extends in a radial direction from the periphery of the first element 71. The best performance is achieved when the pins 75 are evenly angularly separated, in this case with an angular value a equal to 120 degrees provided identical slits 74 on the interconnecting element 73.

The interconnecting element 73 is attached to the second element 72 by fastening means, such as glue or the like, for fixing the interconnecting element 73 to the second element 72.

The displacement of the elements is performed by rotating the first element 71 while each pin 75 follows each slit 74. The accuracy of this embodiment can be increased by creating a compressing force utilising spring means, as previously described in FIG. 2.

Figure 5C:
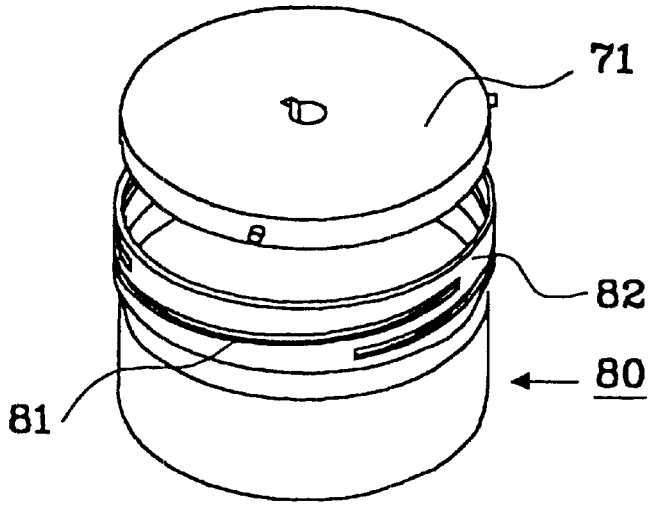
FIG. 5*c* shows an exploded perspective view of a three-part resonator body comprising two resonating elements and a second type of interconnecting element with an overlapping tracking guide in combination with a tracking means in accordance with the inventive concept.
Figure 5D:
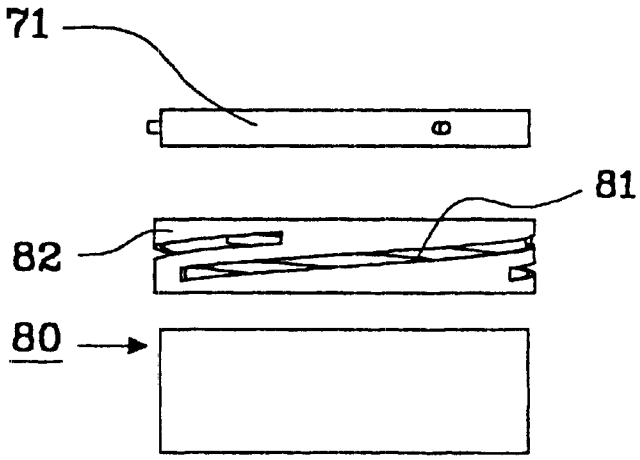
FIG. 5*d* shows a side view of the embodiment in FIG. 5*c*.

FIG. 5*c* and 5*d* shows an embodiment of a three-part resonator body 80, similar to the embodiment in FIGS. 5*a*–5*b*, except for the arrangement of the slits 81 in the tubular wall of the interconnecting element 82. The slits in this example is of an overlapping type in contrast to previous embodiment where the slits are non-overlapping.

By introducing overlapping slits the sensitivity of the rotation of the first element 71 may be reduced and a higher accuracy can be obtained.

The slope of the ridges and the slits in the previous figures are linear, but the invention should not be limited to this. An increasing slope of any kind may be used provided that the tracking means of the facing surface is conformably adjusted accordingly.

An alternative embodiment (not shown) of said slit formed interconnecting element, is a tubular interconnecting element where the slits are replaced by an inner thread. The pins 75 can be arranged in a manner to fit into the thread and the same function as described in FIGS. 5*a*–5*d* can be obtained.

Other combinations of the above described means for mechanical guidance may of course be done and should be included in the scope of the invention.

The interconnecting elements 51, 61, 73 and 82, may be made out of a dielectric material, glass, aluminium oxide and other material. The resonating elements 31, 32, 41, 51, 52, 65, 71 and 72 may be made a dielectric material with arbitrary characteristics.

By arranging the resonating elements, with or without an interconnecting element, in the above described embodiments, stable designs are achieved. Furthermore the designs are insensitive to temperature variations due to the spring loaded means forcing the resonating elements to a firm contact.

Maximum power handling capacity of is set by maximum allowed energy storage of the resonator, related to break down voltage of air $E_{max}$, which is approx. $E_{max}$=3000 V/mm. The maximum energy storage is directly proportional to maximum peak power. The above described embodiments provides a higher sensitivity (Mhz/mm) and are found, in computer simulations, to be able to handle more power.

What is claimed is:

1. A dielectric resonator comprising:

walls delimiting a cavity, input and output means mounted on said cavity, at least one dielectric resonator body located inside said cavity, being adjustable within a frequency range, said dielectric resonator body includes at least two dielectric resonant elements, a resonance frequency is adjustable by altering the resonant shape of the resonator body, said resonant shape of the resonator body is adjustable by a movement of at least a first resonant element of said resonator body in relation to at least a second resonant element of said resonator body, said movement is performed by rotation of at least the first element around an axis, said elements being in contact with each other, and a distance between a surface of the first resonant element facing a surface of the second resonant element, except in the area where the elements are in contact, is changed when said resonant shape of the resonator body is adjusted.

2. The dielectric resonator according to claim 1, wherein said resonator body further comprises connecting means for connecting said first and second element.

3. The dielectric resonator according to claim 2, wherein said connecting means establishes a contact between said resonating elements in at least one location.

4. The dielectric resonator according to claim 3, wherein said resonating elements are circularly cylindrical and incorporate said connecting means in a circular or part-circular path having a center at said rotation axis.

5. The dielectric resonator according to claim 3, wherein said resonator further comprises means for rotation of said first element relative to said second element, said means for rotation acting on said adjustment means for said displacement and thereby altering the displacement.

6. The dielectric resonator according to claim 1, wherein the size of an air gap between said first and second resonant element, where said elements are not in contact, is changed when the resonant shape of the resonator body is adjusted.

7. A dielectric resonator comprising:

walls delimiting a cavity, input and output means mounted on said cavity, at least one dielectric resonator body located inside said cavity, being adjustable within a frequency range, said dielectric resonator body includes at least two dielectric resonant elements, and a resonance frequency is adjustable by altering the resonant shape of the resonator body, said resonant shape of the resonator body is adjustable by a movement of at least a first resonant element of said resonator body in relation to at least a second resonant element of said resonator body, said movement is performed by rotation of at least the first element around an axis, said elements being in contact with each other, an interconnecting element having a tubular shape, said means for mechanical guidance includes an inner diameter of said tubular interconnecting element being larger than the diameter of said rotating element, a tubular wall of said interconnecting element extending in an axial direction, a tracking guide arranged in said tubular wall, said tracking guide being divided into at least one separate axially incrementing guide part, a tracking means located at the periphery of said rotating element, said means being divided into a number of tracking parts, said number corresponding to at least said number of guide parts on the interconnecting element, said tracking means being supported by said tracking guide, said displacement varies when said tracking means follows said tracking guide when said rotating element rotates, and each guide part of said tracking guide has a uniform shape with a substantially equal axial starting point and a substantially equal axial ending point as compared to other contact sectors.

8. The dielectric resonator according to claim 7, wherein said interconnecting element is fixed to at least one of said resonating elements.

9. The dielectric resonator according to claim 8, wherein said interconnecting element is fixed to said second resonating element.

10. The dielectric resonator according to claim 7, wherein each tracking part of said tracking means is a protruding means extending in a radial direction.

11. The dielectric resonator according to claim 7, wherein said tracking guide is divided into three tracking parts.

12. The dielectric resonator according to claim 7, wherein said tracking guide comprises an internal thread, wherein said tracking means are arranged as threading parts.

13. A dielectric resonator comprising:

walls delimiting a cavity, input and output means mounted on said cavity, at least one dielectric resonator body located inside said cavity, being adjustable within a frequency range, said dielectric resonator body includes at least two dielectric resonant elements, and a resonance frequency is adjustable by altering the resonant shape of the resonator body, said resonant shape of the resonator body is adjustable by a movement of at least a first resonant element of said resonator body in relation to at least a second resonant element of said resonator body, said movement is performed by rotation of at least the first element around an axis, said elements being in contact with each other, said rotation causes a displacement of said first element relative to said second element in a direction of the rotation axis, said resonator body comprises adjustment means for adjustment of said displacement of said first element, said adjustment means incorporates means for mechanical guidance on at least two elements, and the displacement is controlled by said mechanical guidance during rotation, said means for mechanical guidance includes a first annular ridge located on the periphery of a first surface of at least one element, said ridge being divided into at least one contact sector of substantially equal length, each sector having a substantially equal shaping, tracker means located at the periphery of a second surface of at least one element, said second surface opposing said first surface, said tracker means being divided into a number of parts corresponding to at least said number of sectors on the first reside, and a contact between the elements is achieved within each contact sector of said first ridge, and said shape of each contact sector is an axially incrementing slope in said circular path, and includes a substantially equal axial starting point and a substantially equal axial ending point as compared to other contact sectors.

14. The dielectric resonator according to claim 13, wherein said tracking means comprises protruding means extending in a radial direction.

15. The dielectric resonator according to claim 13, wherein said tracking means is located on one of said movable elements.

16. The dielectric resonator according to claim 13, wherein said tracking means forms a second annular ridge located on the periphery of said second surface, each part of said tracking means having a conforming shaping in respect of each contact sector of the first ridge, whereby contact is achieved along a distance of said first and second ridge.

17. The dielectric resonator according to claim 13, wherein said first ridge is located on said first element and said tracker means is located on said interconnecting element, which is fixed to said second element.

18. The dielectric resonator according to claim 13, wherein said first ridge is divided into three contact sectors.

19. A dielectric resonator comprising:

walls delimiting a cavity, input and output means mounted on said cavity, at least one dielectric resonator body located inside said cavity, being adjustable within a frequency range, said dielectric resonator body includes at least two dielectric resonant elements, and a resonance frequency is adjustable by altering the resonant shape of the resonator body, said resonant shape of the resonator body is adjustable by a movement of at least a first resonant element of said resonator body in relation to at least a second resonant element of said resonator body, said movement is performed by rotation of at least the first element around an axis, said elements being in contact with each other, and resilient means acting on at least one of said elements to obtain said contact between said resonating elements.

20. A dielectric resonator comprising:

walls delimiting a cavity, input and output means mounted on said cavity, at least one dielectric resonator body located inside said cavity, being adjustable within a frequency range, said dielectric resonator body includes at least two dielectric resonant elements, and a resonance frequency is adjustable by altering the resonant shape of the resonator body, said resonant shape of the resonator body is adjustable by a movement of at least a first resonant element of said resonator body in relation to at least a second resonant element of said resonator body, said movement is performed by rotation of at least the first element around an axis, said elements being in contact with each other, said walls including a top wall formed with an opening and a bottom wall opposite said top wall, a tuning rod extending in said opening of said top wall, and attaching at least a first resonating element to said tuning rod, and a dielectric support extending from said bottom wall, fixating at least a second resonating element relatively to the cavity, wherein said resonating elements are supported from at least one of said walls, and said tuning rod is resiliently biased to create a force ensuring said contact between said resonating elements.

* * * * *